US010420416B2

(12) United States Patent
Welschoff

(10) Patent No.: US 10,420,416 B2
(45) Date of Patent: Sep. 24, 2019

(54) PAINT BRUSH HEAD WITH PAINT CATCH FUNNEL, FLEXIBLE, EXTENDABLE, AND COMPRESSIBLE BODY AND CONNECTING HANDLE

(71) Applicant: Heinz Welschoff, Fort Lauderdale, FL (US)

(72) Inventor: Heinz Welschoff, Fort Lauderdale, FL (US)

( * ) Notice: Subject to any disclaimer, the term of this patent is extended or adjusted under 35 U.S.C. 154(b) by 0 days.

(21) Appl. No.: 15/928,486

(22) Filed: Mar. 22, 2018

(65) Prior Publication Data

US 2018/0206623 A1 Jul. 26, 2018

Related U.S. Application Data

(63) Continuation-in-part of application No. 15/015,842, filed on Feb. 4, 2016, now abandoned.

(51) Int. Cl.
*A46B 5/00* (2006.01)
*A46B 15/00* (2006.01)

(52) U.S. Cl.
CPC ..... *A46B 5/0062* (2013.01); *A46B 5/0075* (2013.01); *A46B 5/0095* (2013.01); *A46B 15/0048* (2013.01); *A46B 2200/202* (2013.01)

(58) Field of Classification Search
CPC ... A46B 5/0062; A46B 5/0075; A46B 5/0095; A46B 15/0048
See application file for complete search history.

(56) References Cited

U.S. PATENT DOCUMENTS

| | | | | |
|---|---|---|---|---|
| 5,084,932 A * | 2/1992 | Zanchi | A46B 11/0093 | 15/168 |
| 5,185,938 A * | 2/1993 | Hutt | A46B 17/06 | 15/246 |
| 5,711,759 A * | 1/1998 | Smith | A61J 17/006 | 601/139 |
| 7,222,381 B2 * | 5/2007 | Kraemer | A61C 17/22 | 15/22.1 |
| 9,986,817 B1 * | 6/2018 | Wesley | A46B 9/026 | |
| 2002/0066151 A1 * | 6/2002 | Parker | A46B 5/0075 | 15/172 |

* cited by examiner

*Primary Examiner* — Shay Karls
(74) *Attorney, Agent, or Firm* — Melvin K. Silverman

(57) ABSTRACT

A paint brush system, including a number of bristles held together inside the paint catch funnel and at also a bristles holder of the base providing a paint catch funnel circumferentially and about a lower enclosed area about each of the bristles, therein forming of the catch funnels of the base of the paint brush; whereas the paint catch funnel is connected to the upper part of the head, and between a bottom head and the top connector of the flex accordion-like neck, the neck is inserted and locked into the bottom head; at the bottom of the flex accordion-like neck, linearly repeatedly and extensively an element and also providing a transversely aspect of the flex accordion-like element and providing from an uppermost to a bottommost, and of the repeatedly element accordion ends; and further a threaded nonslip handle is provided at the end of the paint brush system.

17 Claims, 6 Drawing Sheets

500

500

PAINT BRUSH HEAD WITH PAINT CATCH FUNNEL, FLEXIBLE, EXTENDABLE, AND COMPRESSIBLE BODY AND CONNECTING HANDLE

RELATED U.S. APPLICATION

This is a continuation-in-part of application Ser. No. 15/015,842, filed Feb. 4, 2016, and the same is incorporated by reference in its entirety herein.

FIELD OF THE INVENTION

This invention relates to paint brushes and, more particularly, paint brushes adapted for ease of attachments to paint brush extension poles to, provide improved methods and apparatus for painting.

BACKGROUND OF THE INVENTION

Paint brushes are commonly used for applying paints, varnishes, pastes, and films of other viscous materials to various articles. The basic design of most paint brushes has gone unchanged for many years. Paint brushes typically include a plurality of bristles which are put together at the base and hold by a metal collar that is connected to the brush head with nails or staples and is attached to a solid wood or plastic handle having an axis parallel to the bristles.

The above set forth physiologic problems and other difficulties suffered by painters is made worse when the painting surface is at a distance above the height of the painter or the height of the painter even when located upon a paint ladder. As such, the use of so-called paint pole extensions has become common place by those in the painting trades. However, a universal problem is that of securing of the paint brush to the paint brush extension pole, it is not directly possible unless a special tool is used and or most of the time duct or other types of tapes, mechanical wire is been used and as to reasonable and capable of control of the paint brush relative to the surface to be painted.

The present invention thereby represents an improvement of attachments of a painter's brush as opposed to the historic use as mention above.

The prior art also does not offer solutions to painting situations in which there exists objects such as bushes, walls, furniture, etc., which represents impediments to reaching of surfaces to be painted. Another difficulty with state-of-the art paint brushes, whether used with a paint extension pole or not, is control of dripping or splashing of paint from the bristles of the brush.

The present invention also addresses this need in the prior art.

The present invention also lends itself to storage in a resealed clam shell packaging or the like in order to minimize oxidation of paint left upon the bristles even after the paint brush has been cleaned following a work assignment.

Embodiments of the present invention also facilitate painting of surfaces other that one at a right angle to the paint brush, a subject which has always presented difficulty to painter's past.

The present invention is also concerned with the reduction of cost of material of the paint brush and also certain solutions thereto.

Through a novel method of securement of the paint brush bristles inside the paint catch funnel that is connected to the brush head of the paint brush, and splattering of paint away from the brush head and otherwise is considerably reduced.

While numerous references teach the use of a paint bucket or paint bucket accessory which can be used to reduce dripping or splashing from the paint brush there, to the knowledge of the present inventor, does not exist any paint brush which includes an internal construction for the reduction of paint splashing, spillage or the like. See for example. See for example U.S. Patent Application Publication 2008/035650 (2008) to Rittman.

With respect to the prior art of efforts to extend the length or reach of a brush, in combination with a paint brush extension pole, only limited efforts have appeared, such as in U.S. Patent Publication 2002/0066151 (2002) to Parker, entitled Paint Brush With Angle Adjustable Handle and U.S. Pat. No. 8,839,480 (2014) to Thomas, entitled Extend A Brush. While adjustable angles paint brushes are known, no such devices have been adapted for use in combination with a paint brush extension pole.

The present invention addresses this long-felt need in the art.

Paint brushes of this general type are ordinarily used by manually clasping the handle of the brush with the hand and manipulating the brush in a back and forth manner by bending the arm and wrist in a natural fashion. This method generally works well when the surface being worked with the brush is directly in front of and facing the painter. However, when the surface being painted is, for example, above or below the painter and/or facing away from the painter, the bristle head of the brush must be angled to paint such a surface. This is normally accomplished by bending and/or twisting the wrist, arm, and/or shoulder of the hand that manipulates the brush. Unfortunately, such manipulations can be very uncomfortable especially during prolonged painting and can even injure the painter's wrist, arm, shoulder, and/or neck.

Accordingly, an improved paint brush is needed which permits the wrist and other parts of the body to be maintained in a more natural attitude while accomplishing more effective painting at various elevations.

SUMMARY OF THE INVENTION

A paint brush system, including: a plurality of bristles held together inside of the paint catch funnel at the base of the paint brush, circumferentially and about a lower enclosed area about each of said bristles, therein a lower head beneath the bristles holder-paint catch funnel an integration between the lower head and a top connector of an accordion-like neck; at the top connector of the accordion-like neck, linearly repeatedly and extensively an accordion-like element and also providing a transversely flexibly aspect of the accordion-like element and providing from an uppermost to a bottommost, and of said repeatedly element accordion ends; and further an internal threaded nonslip distal handle is provided at the end of the paint brush.

It is a further object to provide a paint brush which can bend about a central axis thereof within a range of 0 up to 90 degrees, but most generally about 45 degrees.

It is a yet further object of the invention to provide a paint brush of the above type in which the use of construction and all plastic material therefore is minimized through the use of a longitudinal internal channel.

It is accordingly an object of the present invention to provide a paint brush with a paint bristle paint catch funnel included at the base of the securing recess at the front or bristle support region of the paint brush in which, by virtue of the geometry of the bristle support region, the escape of the paint through splashing, dripping or otherwise from the paint brush head is minimized.

The above and yet other objects and advantages of the present invention will become apparent from the hereinafter set forth Brief Description of the Drawings, Detailed Description of the Invention and Claims appended herewith.

DETAILED DESCRIPTION OF THE INVENTION

Figure 1:
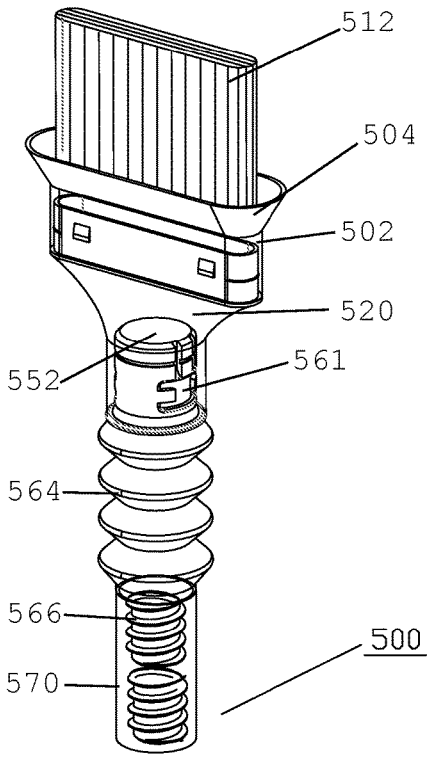
FIG. 1 is a prospective assembled view of my inventive paint brush with brush bristles and flexed accordion elements or ribs near to the bottom of said assembly.
Figure 2:
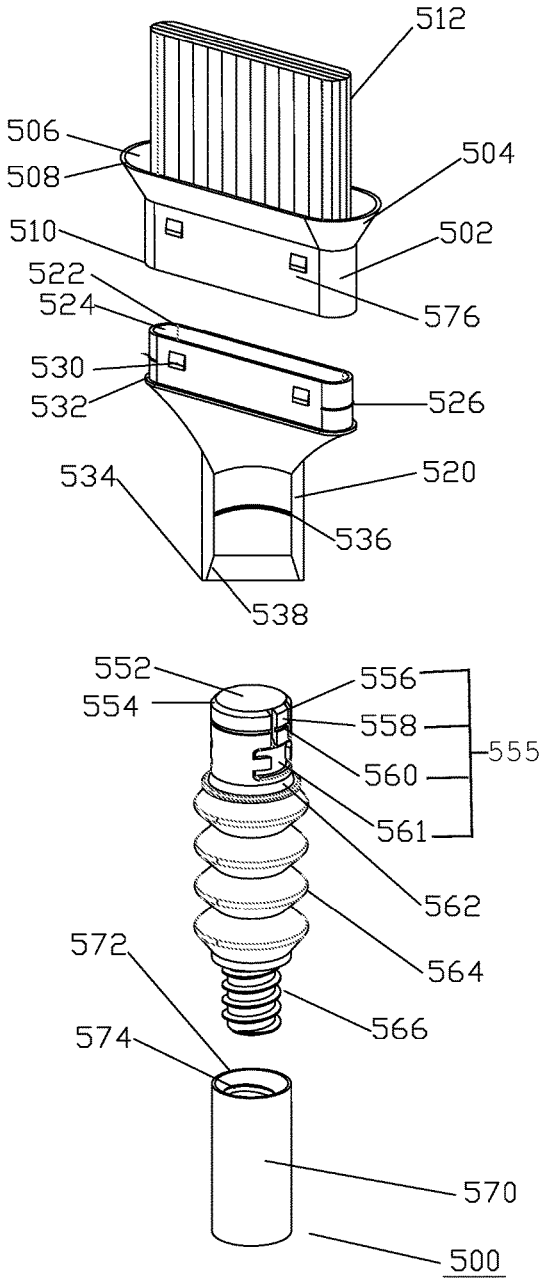
FIG. 2 is an expended view of the article of FIG. 1.

With reference to FIGS. 1 and 2, of the present inventive paint brush 500, is shown a perspective assembled view. Thereof this includes an internal threaded handle 570, screwed halfway unto a bottom thread 566 of the expandable, collapsible, bendable, body 564, and a top part 552 of an accordion-like neck 564, is locked by a lock 561, at the bottom inside of a lower brush head 520 affixed to a bristles holder including paint catch funnel as a one piece unit 502 and a paint catch funnel 504 where upper bristles 512 are bunched together.

With reference to FIG. 2, of the present inventive paint brush 500, is shown all parts disassembled in a vertical view.

From the bottom up, there is an internal threaded handle 570, showing its' top view 572, and an internal threaded top view 574.

In FIGS. 1 and 2 an expandable, bendable, body 564 with a bottom external thread 566, at the upper part of the expandable, bendable, body in 564 is a closed or open top 552, a 45-degree angle part 554, four spline grooves 556, two on each side of locking system 555, a male spline 558, one on each side of locking system 555, a locking system all around groove 560 and 561.

expandable, bendable, body in a plastic material 564, to receive the internal threaded handle 570, unto the bottom threaded section 566, top view 572 of the internal threaded handle 570, and internal thread 574 join at the bottom of the expandable, bendable, body in a plastic material 564.

An external 45-degree angle part 562 at the upper number four flex rib of accordion-like neck 564. A bottom view 534 of the lower brush head 520, an internal 45-degree angle part 538 of the lower brush head 520.

A lower head 520, with an internal locking ring 536, with two external locking rings 526, one at each rounded end, four external male locking locks 530, two on each side. One resting wall 532, hollow space 524, top of lower head 522.

A bristles holder 502 with a deep and wide-angle paint catch funnel 504, installed bristles 512, deep and wide-angle paint catch funnel space 506 all around the bristles 512, top of paint catch funnel 508, four internal female locks 576, two on each wider side of bristles holder 502, bottom of a paint catch funnel 510. In a further embodiment, the installed bristles 512 can cut to an angle which are angled relative to a surface of which the bristles 512 will come in contact with.

The bottom 510 of the bristles holder 502 with paint catch funnel 504, stops at the resting wall 532 of the lower head 520. The paint catch funnel 504 of the bristles holder including paint catch funnel as one piece 502, must be at least 10 mm deep and 8 mm space from the bristles.

Figure 3:
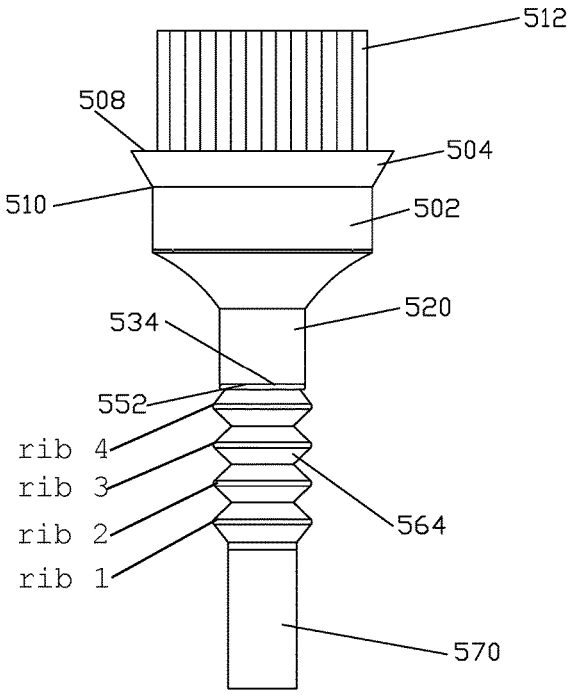
FIG. 3 is a complete assembled front vertical flat view of FIG. 1.

With reference to FIG. 3, of the present inventive paint brush 500 is a complete assembled vertical front or rear view whereas number 4, 3, 2 and 1 flex ribs are extended. See FIGS. 7-8.

Starting from the bottom or proximal end thereof, said paint brush 500 includes an internal threaded handle 570, an expandable, bendable, body material 564, a lower brush head 520, a bristles holder including paint catch funnel as a one piece unit 502, with a paint catch funnel 504, top of paint catch funnel 508, bottom of deep paint catch funnel 510, bottom of lower head 534, top of a first ring of the expandable, bendable, body 552 with 1, 2, 3 and 4 flex ribs. Bristles 512 installed into deep and wide-angle paint catch funnel 504.

Figure 4:
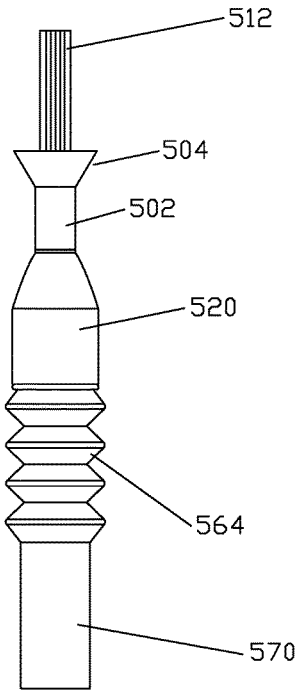
FIG. 4 is a side view of FIG. 3.

With reference to FIG. 4. of the inventive paint brush 500 is a side view with all the same parts as FIG. 3. Starting from the bottom or proximal end thereof, said paint brush 500 includes an internal threaded handle 570, expandable, bendable, body 564, lower brush head 520, bristles holder 502, paint catch funnel 504, and bristles 512.

Figure 5:
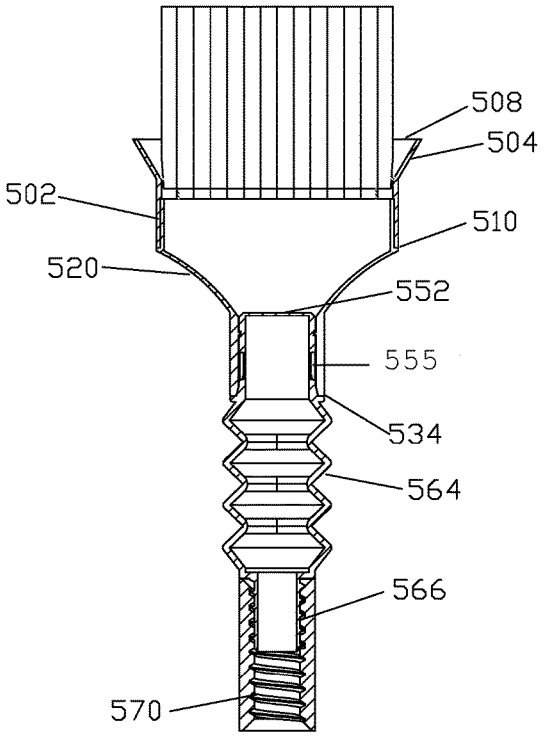
FIG. 5 is a complete vertical cut away view of FIG. 3.

With reference to FIG. 5, of the paint brush 500, is shown a view of the front cut away of FIG. 3. All with the same parts as mention above in FIG. 3. An internal threaded handle 570, an expandable, bendable, body 564 with a bottom external thread 566, a bottom view 534 of the lower brush head 520, locking system 555, a top of a first ring of the expandable, bendable, body 552, a bottom of a paint catch funnel 510, a paint catch funnel 504, a top of paint catch funnel 508 (see FIG. 3), bristles holder 502. Locking system 555 consists of four spline grooves 556 (see FIG. 2), two on each side of locking system 555, a male spline 558, one on each side of locking system 555, a locking all around groove 560 and a lock 561.

Figure 6:
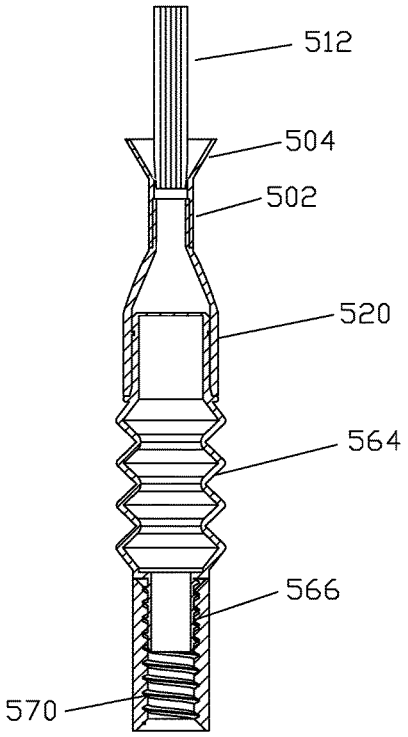
FIG. 6 is a vertical cut away view of FIG. 5.

With reference to FIG. 6, of the paint brush 500, is shown a vertical cut away side view assembly of FIG. 5. An internal threaded nonslip handle 570, an expandable, bendable, body 564 with a bottom external thread 566, a lower head 520, bristles holder 502, a paint catch funnel 504, bristles 512.

Figure 7:
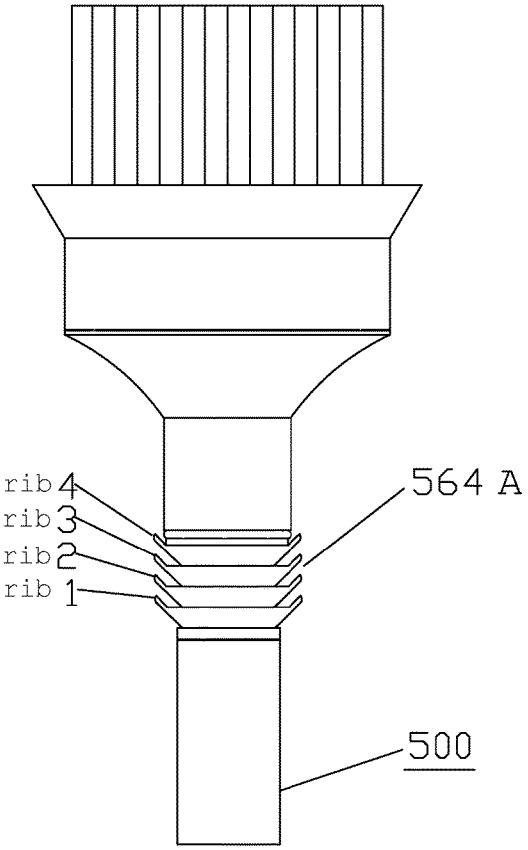
FIG. 7 is a vertical view of a fully compressed flexed accordion elements or ribs of FIGS. 1-6.

With reference to FIG. 7, of the paint brush 500, is shown a vertical view of a fully expandable, bendable, body elements or ribs of FIGS. 1-6, whereas the expandable, collapsible, bendable, body in a plastic material 567 A, all flex ribs 1-4 are collapsed in a bendable position. All with the same parts as mention above.

Figure 8:
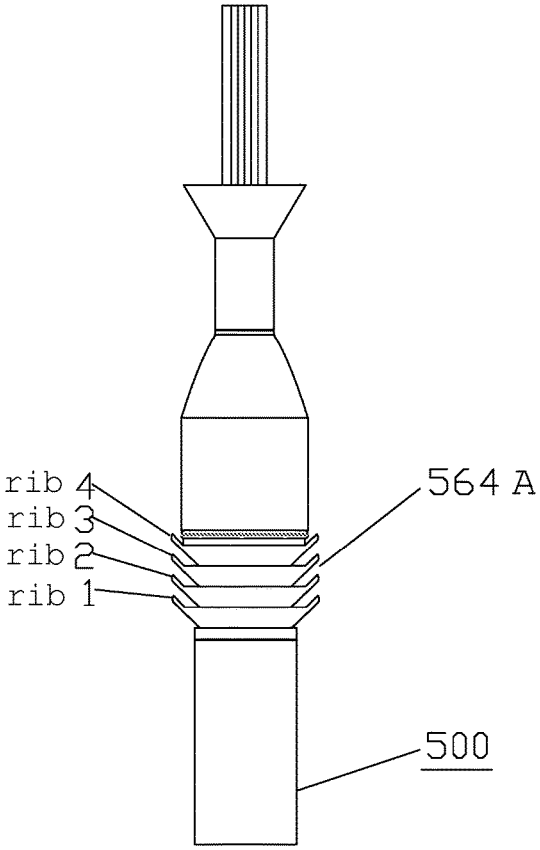
FIG. 8 is a side view of FIG. 7.

With reference to FIG. 8, of the paint brush 500, is a side view of FIG. 7, whereas the accordion-like neck 564 A, all flex ribs 1-4 are collapsed in a bendable position. All with the same parts as mention above.

Figure 9:
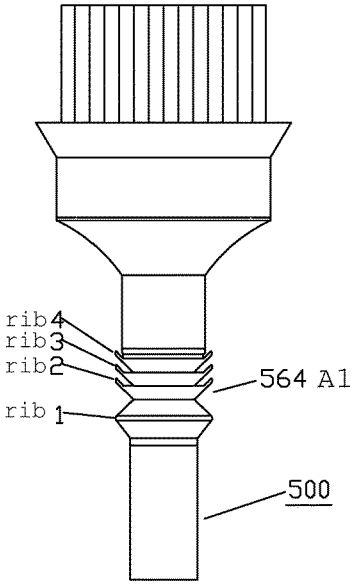
FIG. 9 is a view of FIG. 7 having three compressed ribs and only one accordion element without compression thereof.

With reference to FIG. 9, of the paint brush 500, is a view of FIG. 7 having three ribs collapsed 2-4 and only number one of the expandable, collapsible, bendable, body in a plastic material rib is without collapsed position thereof, whereas the accordion-like neck 564A1, flex rib number one has been extended.

Figure 10:
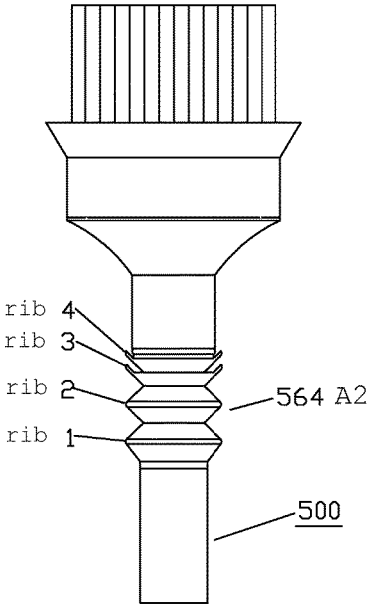
FIG. 10 is a view of FIG. 9 having two compressed ribs and two accordion elements without compression thereof.

With reference to FIG. 10, of the paint brush 500, a view of FIG. 9 having two compressed ribs 3-4 and two accordion elements rib 1 and rib 2 without compression thereof, whereas the accordion-like neck 564A2, flex ribs number one and two have been extended.

Figure 11:
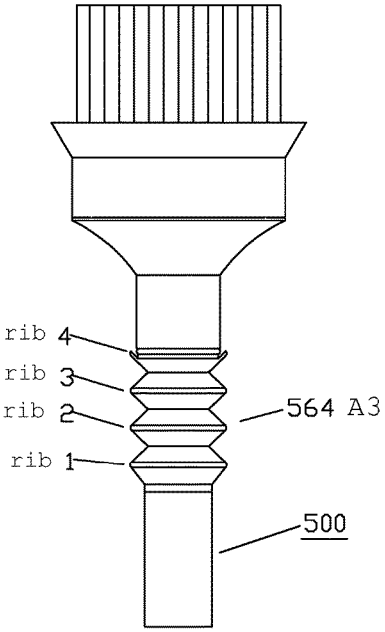
FIG. 11 is a view of FIG. 10 having only one compressed rib and three accordion elements without compression thereof.

With reference to FIG. 11, of the paint brush 500, is view of FIG. 10 having only one compressed rib 4 and three body ribs 1-3 without compression collapsed thereof, whereas the expandable, bendable, body in a plastic material 564A3, flex ribs number one, two and three have been extended.

Figure 12:
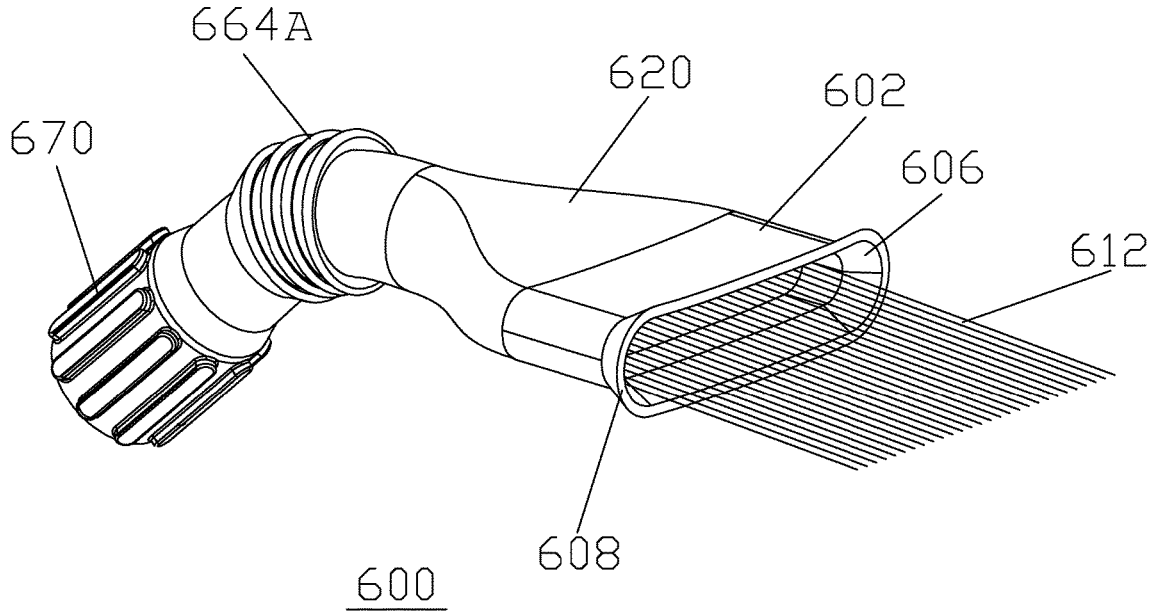
FIG. 12 is a paint catch funnel and bristles view, whereas a flex is bent about range of 0 to about 90 degrees and the internal threaded handle at the bottom.

With reference to FIG. 12 of the paint brush 600, is a paint catch funnel 606 and bristles 612, whereas an expandable, collapsible, bendable, body in a plastic material 664A is bent about range of 0 to about 90 degrees and the internal threaded handle 670 at the bottom. A brush head 620, bristles holder including paint catch funnel as one piece unit 602, paint catch funnel 606, top of paint catch funnel 608, and bristles 612.

I claim:

1. A paint brush system, comprising:

(a) a plurality of bristles held together upon at a base of a paint brush, and also at a bristles holder of the said base providing a catch funnel circumferentially about a lower enclosed area about each of said bristles, therein forming of the catch funnel of said base of the paint brush, and said catch funnel integrally part of said base of the paint brush;

(b) a head beneath said bristles holder;

(c) an integration between said head and a top connector including an accordion-like elongate neck;

(d) said neck having a sequence repeatedly of accordion-like geometry including a series of circumferential ribs between each said accordion-like geometry, each defining selectable extensible or compressible geometry between ribs, and also providing a transversely flexible aspect of said elongate neck including a bottommost end of said accordion-like neck; and (e) a threaded nonslip distal handle of the paint brush.

2. The paint brush as recited in claim 1, in which the top connector consists of a top part of an accordion-like neck connects to a lower head using about 45-degree angle part for easy insertion and a locking system comprised of four spline grooves, two on each side of the locking system, a male spline, one on each side of the locking system, a circumferential locking groove and a lock.

3. The paint brush as recited in claim 1, in which a longitudinal length of said elongate neck defines a length generally equal to that of said bristles when secured within said bristle holder.

4. The paint brush as recited in claim 1, in which a distal segment of a channel of said accordion-like neck extends into a portion of said bristle holder.

5. The paint brush as recited in claim 4, said accordion-like geometry defining angulations totaling 0 to 90° degrees relative to an axis of said channel of the paint brush.

6. The paint brush as recited in claim 1, in which said bristles holder includes an upper region, proportioned for receipt of bases of paint bristles therein, said upper region defining mutually slanted planes in a range of about 20 to about 50 degrees relative of the paint brush, said upper region defining a paint catch funnel directing excess or splashed paint toward said bristles holder.

7. The paint brush as recited in claim 1, in which said brush head is hollow.

8. The paint brush as recited in claim 1, said threaded nonslip distal handle of the paint brush handle having a gnarled surface comprising said nonslip distal handle.

9. The paint brush as recited in claim 1, in which a selectable securement of said bristles into said bristles holder includes a pressure fit securement.

10. The paint brush as recited in claim 1, in which said selectable securement of said bristles into said bristles holder includes a glue-implemented securement.

11. The paint brush as recited in claim 10, further including a perforated tape secured about said base of said bristles before glue is applied thereto.

12. The paint brush as recited in claim 11, in which a length of bristles secured within said bristles holder to an entire bristle length, defines a range of between about 30 and about 50 percent.

13. A paint brush, comprising:

(a) distally of an accordion-like material and integral therewith, an integral bristle support region having a bristles holder proportioned for selectable securement of paint brush bristles therein, said bristles holder including an upper and a lower region, said lower region proportioned for receipt of bases of bristles paint therein, said upper region defining inner and outer mutually slanted planes in a range of about 0 to about 50 degrees relative to said hollow axial channel of the paint brush, said upper and lower regions defining a paint catch funnel directing excess or splashed paint toward said upper head;

(b) an integration between a head and a top connector including an elongate-like neck;

(c) said neck having a sequence repeatedly of accordion-like geometry including a series of circumferential flexible ribs between each of said accordion-like geometry, each defining selectably extensible or compressible geometry between ribs, and also providing a transversely flexible aspect of said elongate neck including a bottommost end of said neck; and (d) a handle including a base defining a substantially solid cylinder, said base further defining a proximal region of an internal threaded handle, said internal threaded handle having an axial hollow channel therein, said channel having a threaded interior beginning at a proximal end of said channel, and ending at a distal end of said handle, said threading proportioned for engagement of an end of a threaded paint extension pole.

14. The paint brush as recited in claim 13, in which a longitudinal length of said elongate neck defines a length generally equal to that of said bristles when secured within said bristle holder.

15. The paint brush as recited in claim 13, in which said brush head is hollow.

16. The paint brush as recited in claim 13, in which said internal threaded nonslip distal handle of the paint brush handle having a gnarled surface comprising said nonslip distal handle.

17. The paint brush as recited in claim 13, in which said selectable securement of said bristles into said bristles holder includes a glue implemented securement.

* * * * *